United States Patent [19]

Rafael et al.

[11] Patent Number: 4,462,637

[45] Date of Patent: Jul. 31, 1984

[54] CONTROL APPARATUS FOR INCLINATION OF LONGWALL GUIDE

[75] Inventors: Werner Rafael, Lunen; Egon Pfefferle, Hamm, both of Fed. Rep. of Germany

[73] Assignee: Gewerkschaft Eisenhutte Westfalia, Lunen, Fed. Rep. of Germany

[21] Appl. No.: 329,911

[22] Filed: Dec. 11, 1981

[30] Foreign Application Priority Data

Dec. 13, 1980 [DE] Fed. Rep. of Germany ..... 3047064

[51] Int. Cl.[3] ..... E21C 35/08; E21D 23/04

[52] U.S. Cl. ..... 299/32; 299/43; 405/295

[58] Field of Search ..... 299/32, 31, 34, 43; 405/299, 297, 300, 301

[56] References Cited

U.S. PATENT DOCUMENTS

| | | | |
|---|---|---|---|
| 3,649,078 | 3/1972 | Grebe | 299/32 |
| 3,874,734 | 4/1975 | Plevak | 299/32 |
| 3,915,500 | 10/1975 | Schlusener | 299/32 |
| 4.243,268 | 1/1981 | Lobbe | 299/81 |

FOREIGN PATENT DOCUMENTS

| | | | |
|---|---|---|---|
| 1290507 | 3/1969 | Fed. Rep. of Germany | 299/32 |
| 2221465 | 11/1973 | Fed. Rep. of Germany | 299/32 |
| 1085871 | 10/1967 | United Kingdom | 299/43 |

*Primary Examiner*—Ernest R. Purser

*Attorney, Agent, or Firm*—Sughrue, Mion, Zinn, Macpeak, and Seas

[57] ABSTRACT

Apparatus for controlling the cutting horizon of a mineral winning plough comprises means for pivoting the guide along which the plough moves. The guide is fixed to the face side of the conveyor, and said means acts on the goaf side of the conveyor. Said means comprises a plurality of control devices, each of which has an upstanding plate fixed to the goaf side of the conveyor, an abutment member pivotally connected to the base of the upstanding plate, and an actuator arranged between the abutment member and the upstanding plate. The actuators are effective to pivot the conveyor relative to the abutment members. Each actuator comprises a hydraulic ram and a toggle linkage which magnifies the working stroke of the ram.

3 Claims, 2 Drawing Figures

R
II
II

CONTROL APPARATUS FOR INCLINATION OF LONGWALL GUIDE

BACKGROUND TO THE INVENTION

The present invention relates to a mineral mining installation, and in particular, to apparatus for controlling the inclination of a mineral face conveyor having a guide for a mining or winning machine.

One form of control apparatus, described in U.S. Pat. No. 3,915,500, uses hydraulic rams connected between the guide and elongate guide rods. The guide rods are pivotable in relation to the guide and are guided on roof support units. In this known construction, the guide is attached to the face side of a scraper-chain conveyor, and the roof support units are coupled to brackets on the conveyor goaf side. The rams, which are used to tilt the conveyor and its guide into various inclinations, are connected to the guide rods at positions spaced outwardly from the conveyor relative to the positions at which the guide rods are connected to the brackets. The guide rods are usually guided, at their ends remote from the conveyor, for movement in the direction of conveyor advance; and advance rams act on the conveyor, via the guide rods, to advance the latter to follow the winning progress. The guide rods are restrained from vertical movement at their rear ends, although pivotal or angular mobility is permitted. The guide rods also serve to align and guide the roof support units when these are drawn up to follow the advance of the conveyor. There is a direct relationship between the stroke of the rams and the inclination of the conveyor and its guide; and this is not influenced to any great extent by uneveness in the level of the floor of the mine working, since the contact zones between the floor and the various parts of the mine installation are well spaced apart. This known form of control apparatus has generally performed well, but its main disadvantage is that the space between the conveyor and the roof support units tends to become restricted and access is difficult.

The object of the present invention is to provide an improved form of control apparatus. In particular, it is an object of the invention to provide control apparatus which permits adequate control movements using rams having relatively short working strokes. Another object is to provide control apparatus which occupies only a small part of the access region between the conveyor and the associated roof support units.

SUMMARY OF THE INVENTION

In its broadest aspect, the present invention provides apparatus for controlling the inclination of mineral mining equipment, the apparatus comprising an abutment member pivotally attached to the equipment, and means for pivoting the equipment relative to the abutment member, said means comprising a prime mover and a linkage for magnifying the movement of the prime mover.

Advantageously, the prime mover is a hydraulic ram, and the linkage is a toggle linkage. Preferably, the linkage is a double-toggle linkage, the double-toggle linkage having four links pivotally connected together in the form of a parallelogram by two pairs of opposed pivot joints, the hydraulic ram being pivotally connected to the pivot joints of one said pair of opposed pivot joints, one of the pivot joints of the other pair of pivot joints being attached to the abutment member, and the other pivot joint of said other pair of opposed pivot joints being attached to the equipment. In this case, the hydraulic ram may be disposed substantially horizontally, and said other pivot joint of said other pair of opposed pivot joints is positioned above said one pivot joint of said other pair of opposed pivot joints.

The equipment may comprise a longwall conveyor channel section, a guide section attached to one side of the channel section, and an upstanding plate attached to the other side of the channel section, the abutment member being pivotally connected to the base of the upstanding plate, and said other pivot joint of said other pair of opposed pivot joints being attached to the upstanding plate adjacent to the top thereof.

The invention also provides a mineral mining installation comprising a longwall conveyor having a plurality of channel sections joined together end-to-end, a guide attached to the face side of the conveyor, a plough movable to and fro along the guide, a plurality of roof support units positioned side-by-side adjacent to the goaf side of the conveyor, each of the roof support units being attached to the conveyor by a respective advance mechanism, and means for controlling the inclination of the conveyor so as to control the cutting horizon of the plough, wherein said control means comprises a plurality of control devices, each of the control devices being associated with a respective conveyor channel section, wherein each control device includes an upstanding plate fixed to the goaf side of the respective channel section, an abutment member pivotally attached to the base of the upstanding plate, and an actuator connected between the abutment member and the upstanding plate for pivoting the channel section relative to the abutment member, said actuator comprising a prime mover and a linkage for magnifying the movement of the prime mover.

Preferably, the advance mechanism of each of the roof support units includes guide rod means attached to the associated abutment member, said guide rod means being guided for movement in a direction perpendicular to the longitudinal direction of the conveyor by guide means associated with the respective roof support unit.

The invention further provides apparatus for controlling the cutting horizon of a mineral mining winning machine which is movable along a machine guide, the apparatus comprising an abutment member pivotally attached to the machine guide, and means for pivoting the machine guide relative to the abutment member, said means comprising a prime mover and a linkage for magnifying the movement of the prime mover.

The invention also provides apparatus for controlling the cutting horizontal of a mineral winning machine which is movable along a machine guide fixed to the face side of the conveyor, the apparatus comprising a plurality of control devices for pivoting the conveyor, each control device comprising an abutment member pivotally attached to the conveyor, and means for pivoting the conveyor relative to the abutment member, each of said means comprising a prime mover and a linkage for magnifying the movement of the prime mover.

Advantageously, each of the abutment member is connected to an associated roof support unit positioned on the goaf side of the conveyor by means of an advance mechanism connected to that roof support unit, the advance mechanism including guide rod means attached to that abutment member.

BRIEF DESCRIPTION OF THE DRAWINGS

A mineral mining installation incorporating control apparatus constructed in accordance with the invention will now be described, by way of example, with reference to the accompanying drawings, in which.

DESCRIPTION OF PREFERRED EMBODIMENT

Figures 1, 2:
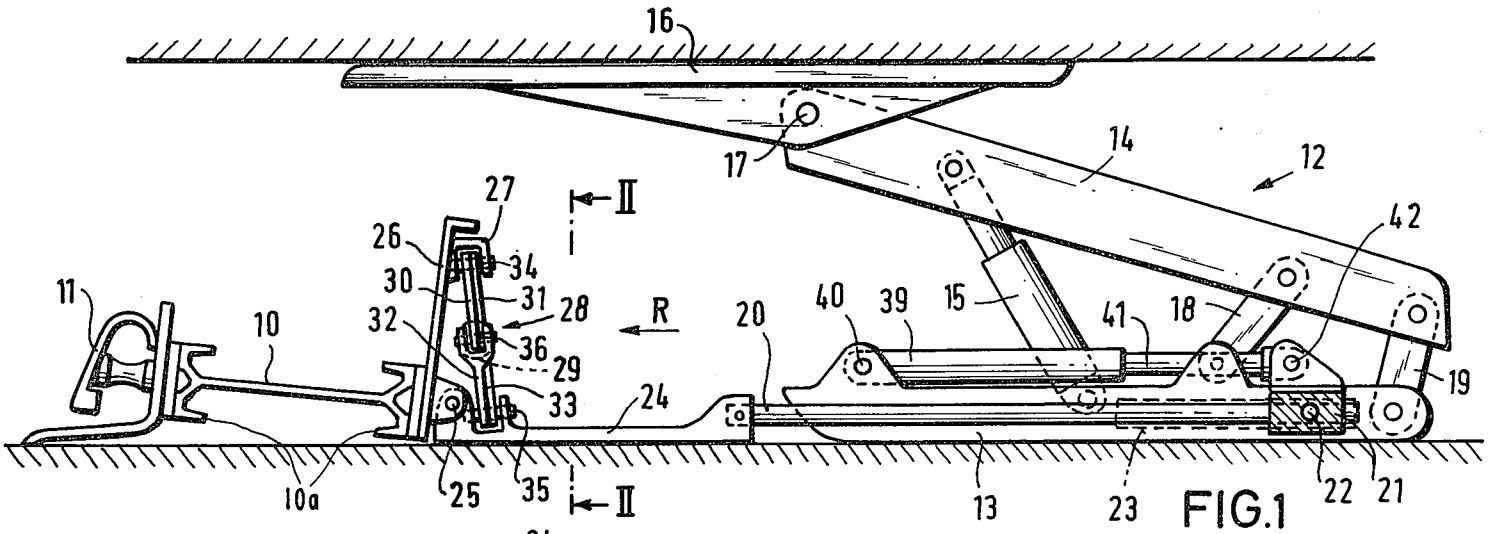
FIG. 1 is a part-sectional side elevation of part of the installation.
FIG. 2 is a part-sectional end elevation of part of the control apparatus.

Referring to the drawings, FIG. 1 shows a scraper-chain conveyor 10 constituted by a plurality of channel sections 10*a* (pans) which are connected together end-to-end in such a manner as to permit limited articulation. The conveyor 10 extends along a longwall working adjacent to a mineral (for example, coal) face. The conveyor 10 can be advanced, to follow up the advance of the face, in a snaking movement.

A guide 11, having a ramp-like guide surface, is provided at the face side of the conveyor 10. A winning machine (not shown), such as a plough, is movable to and fro along the guide 11 to win mineral material from the face in a known manner. A roof support assembly, constituted by a plurality of roof support units 12 (only one of which is shown in FIG. 1), is positioned at the goaf side of the conveyor 10. The roof support units 12 are spaced from the conveyor 10. Each of the roof support units 12 has a floor side constituted by a pair of spaced floor girders 13 (only one of which can be seen), a goaf shield 14, and a roof bar 16 supported on the floor girders by means of hydraulic props 15. The roof bar 16 is pivotally connected to the goaf shield 14 by means of a pivot joint 17. The goaf shield 14 is pivotally attached to each of the floor girders 13 by means of respective lemniscate linkages 18, 19. Each of the props 15 is articulatedly interposed between the goaf shield 14 and a respective one of the floor girders 13.

Each roof support unit 12 is attached to the conveyor 10 by means of a respective advance mechanism. Each advance mechanism has a pair of cylindrical, resilient guide rods 20 (only one of which can be seen in the drawings). The rear (goaf-side) ends of the guide rods 20 are interconnected by a cross-piece 21. The cross-piece 21 is guided, for movement in the direction R of advance, by means of peg-shaped guide elements 22 and elongate slideway guides 23. The guide elements 22 are attached to the cross-piece 21 at opposite sides thereof, and the guides 23 are fixed to the floor girders 13. The front (face-side) ends of the guide rods 20 are interconnected by a head-piece or abutment member 24. The head-piece 24, which has the form of a shallow trough, is pivotally attached to the goaf side of the conveyor 10 by means of a pivot joint 25. The pivotal axis of the pivot joint 25 extends parallel to the longitudinal direction of the conveyor 10. Thus, the guide rods 20 are pivotable, together with the head-piece 24, relative to the floor girders 13 in a plane perpendicular to the floor of the working. However, the engagement of the guide elements 22 within the girders 23 prevents the guide rods 20 from being lifted bodily.

The pivot joints 25 are attached to upstanding plates 26 which are welded to the goaf sides of the channel sections 10*a* of the conveyor 10. Each of the plates 26 extends upwardly well beyond the upper surface of the goaf-side side wall of the associated channel section. Brackets 27 are fixed to the plates 26, each bracket being positioned above a respective pivot joint 25. Each bracket 27 is mechanically connected to its pivot joint 25 by means of a double-toggle linkage 28 and a hydraulic ram 29. Each linkage 28 is constituted by four links 30, 31, 32 and 33 arranged in the form of a parallelogram linkage system. The links 30 and 31 of each linkage 28 are pivotally connected to one another, and to the associated bracket 27, by means of a pivot joint 34. Similarly, the links 32 and 33 of each linkage are pivotally connected to one another, and to the head-piece 24 attached to the associated pivot joint 25, by means of a pivot joint 35. As shown in FIG. 2, each pivot joint 34 is positioned above the associated pivot joint 35. Moreover, as shown in FIG. 1 each pivot joint 35 is positioned on the goaf side of the respective pivot joint 25. The two links 30 and 33 of each linkage 28 are pivotally connected by means of a pivot joint 36, and the two links 31 and 32 of that linkage are pivotally connected by means of a pivot joint 37. The hydraulic ram 29 of each linkage 28 is pivotally connected to the pivot joints 36 and 37 of that linkage, the ram being disposed substantially horizontally. Thus, the cylinder of each ram 29 is pivotally connected to the associated pivot joint 36, and the piston rod 38 of that ram is pivotally connected to the associated pivot joint 37.

It will be apparent that extension of a given ram 29 causes the associated pivot joints 36 and 37 to move away from one another, and causes the associated pivot joints 34 and 35 to move towards one another. Extension of the rams 29 thus cause the associated linkages 28 to form "flatter" parallelograms. As the rams 29 are extended, the conveyor 10 is tilted in such a manner that the plough guide 11 is raised. Similarly, retraction of the rams 29 separates the associated pivot joints 36 and 37, and moves the associated pivot joints 34 and 35 towards one another. Hence, the conveyor 10 is tilted in the other direction, that is to say so as to lower the plough guide 11.

FIG. 1 shows that the linkages 28 lie close to, and slightly angled in relation to, the goaf-side side wall of the conveyor 10. Consequently, the linkages 28 (and the associated rams 29) occupy only a small amount of the access space defined between the goaf side of the conveyor 10 and the face side of the roof support units 12. Moreover, the double-toggle linkages 28 are such as to magnify the working strokes of the rams 29, that is to say the working stroke of a given ram 29 is smaller than the distance through which the associated pivot joint 34 moves relative to the respective pivot joint 35 as a result of said working stroke. Thus, relatively large control movements can be applied to the conveyor 10, so that good control of the cutting horizon of a plough movable along the plough guide 11 is achieved.

As is well known, the guide rods 20 of the advance mechanisms serve to advance the conveyor 10 in the direction R of face advance, and to advance the roof support units 12 in a follow-up movement. For this purpose, each advance mechanism includes a double-acting hydraulic advance ram 39. The cylinder of each ram 39 is pivotally connected to the associated head-piece 24 by means of a pivot joint 40, and the piston rod 41 of that ram is pivotally connected to the associated cross-piece 21 by means of a pivot joint 42. Thus, upon retraction of a given ram 39, the associated conveyor channel section is advanced in the direction R; and, upon extension of that ram, the associated roof support unit 12 is advanced in a follow-up step.

We claim:

1. Apparatus for controlling the inclination of mineral mining equipment, said apparatus comprising an abutment member pivotally attached to the equipment, means carried by said abutment member and operatively engaging said equipment for pivoting the equipment relative to the abutment member, said means comprising: a double-toggle linkage and a hydraulic ram between said abutment and said equipment, said toggle linkage having four links pivotably connected in the form of a parallelogram by two pairs of opposed pivot joints, the hydraulic ram being pivotably connected to the pivot joints of one of said pair of opposed pivot joints, one of the pivot joints of the other pair of pivot joints being attached to the abutment member and the other pivot joint of said other pair of opposed pivot joints being attached to said equipment.

2. Apparatus according to claim 1 wherein the hydraulic ram is disposed substantially horizontally, and said other pivot joint of said other pair of opposed pivot joints is positioned above said one pivot joint of said other pair of opposed pivot joints.

3. Apparatus according to claim 2, wherein the equipment comprises a longwall conveyor channel section, a guide section attached to one side of the channel section, and an upstanding plate attached to the other side of the channel section, the abutment member being pivotally connected to the base of the upstanding plate, and said other pivot joint of said other pair of opposed pivot joints being attached to the upstanding plate adjacent to the top thereof.

* * * * *